United States Patent [19]

Mayer

[11] 4,276,492

[45] Jun. 30, 1981

[54] PLASMA DISPLAY PANEL

[75] Inventor: William N. Mayer, White Bear Lake, Minn.

[73] Assignee: Modern Controls, Inc., Elk River, Minn.

[21] Appl. No.: 46,706

[22] Filed: Jun. 8, 1979

[51] Int. Cl.[3] ..... H01J 61/073; H01J 61/30; H01J 61/36

[52] U.S. Cl. ..... 313/188; 313/217; 313/220

[58] Field of Search ..... 313/217, 220, 188

[56] References Cited

U.S. PATENT DOCUMENTS

| | | | |
|---|---|---|---|
| 3,962,597 | 6/1976 | Clark et al. | 313/188 |
| 3,964,050 | 6/1976 | Mayer | 313/188 X |
| 4,080,597 | 3/1978 | Mayer et al. | 313/217 X |
| 4,164,678 | 8/1979 | Biazzo et al. | 313/217 X |

*Primary Examiner*—Palmer C. Demeo

[57] ABSTRACT

Improved construction of Flat Glass Plasma Display Panel of the type having planar conductors transversely oriented relative to elongated gas channels wherein dielectric separation exists between the planar conductors and gas channels, including preferred relationship between conductor spacing and channel depth, and joining of conductor pairs to facilitate external electrical connections to all conductors.

12 Claims, 9 Drawing Figures

PLASMA DISPLAY PANEL

BACKGROUND OF THE INVENTION

This invention relates to an improvement in construction of flat glass plasma display panels, particularly those panels having conductors on a planar surface orthogonally arranged relative to a plurality of gas channels and separated therefrom by a dielectric material, wherein electrical energization of selected conductors causes gaseous ignition in a gas channel between the conductors, and permits the gaseous ignition to be controllably shifted along the gas channels. Because the electrical conductors are electrically insulated from the gas channels by means of a dielectric medium, panels of this type are characterized as AC plasma shift panels.

AC plasma shift panels have been disclosed in the prior art in different structural forms. For example, my U.S. Pat. No. 3,964,050 issued June 15, 1976, discloses a plurality of parallel conductors supported along a single planar substrate and having a plurality of gas channels orthogonally positioned relative thereto, with dielectric separation between the conductors and the gas channels. Adjacent conductors are connected to different electrical energization means, but every fourth conductor is connected to the same electrical energization means, so as to provide a repetitive electrical connection pattern wherein conductor 1, 5, 9, . . . is connected to voltage source A, conductor 2, 6, 10, . . . is connected to voltage source B, conductor 3, 7, 11, . . . is connected to voltage source C and conductor 4, 8, 12, . . . is connected to voltage source D. The voltage generated by sources A-D are time-phased so as to permit gaseous ignition between conductors 1 and 2, 2 and 3, 3 and 4, 4 and 5, etc. and thereby effectively shift the gas ignition over the respective conductors and along a gas channel. This type of voltage excitation, referred to herein as 4-phase excitation, provides a degree of voltage isolation so as to prevent spurious gaseous ignition between adjacently energized conductors, but suffers from the disadvantage that it requires four different voltage sources in order to shift the ignition along the gas channel. Such voltage isolation is critical in panels of this type, as the conductors are closely spaced in order to create a point ignition source and thereby provide maximum visual resolution of the images displayed on the panel. Conductors are typically spaced 0.005 inch–0.015 inch apart in panels of this type to obtain the visual resolution desired for good commercial quality. External connections to the four sets of planar conductors within the panel are made at two levels. The conductor ends of every fourth conductor are brought out and connected to a common bus line running along the panel on the same plane as the conductors themselves, i.e. the conductors associated with voltage source A; similarly, the conductor ends of all planar conductors connected to voltage source B are connected to a common bus line running along the side opposite the A bus, but also at the same planar level as the conductors. The planar conductors associated with voltage source C are connected via raised posts attached to each of the conductors to a bus line parallel to but at a raised planar level relative to the aforementioned two bus lines; finally, the planar conductors associated with voltage source D are similarly raised through conductive posts to a bus line at a raised planar level on the opposite side of the panel. In this manner, four independent electrical connections may be made to the plurality of parallel conductors, all of which conductors are along the same planar level in the panel.

In my U.S. Pat. No. 4,080,597, issued Mar. 21, 1978, there is disclosed another construction of an AC plasma shift panel wherein all conductors are on the same planar level, but are electrically driven by only three voltage power sources. This has the obvious advantage of requiring fewer voltage sources. The external electrical connections to the planar conductors are similar to that described in the preceding example, with the exception that only a single bus line is required at a raised planar level for connection to every third conductor through raised conductive posts. The voltage excitation of all planar conductors in this panel is accomplished by three time-phased voltage generators which provide the desired voltages for gaseous ignition and the relative timing of these voltages between planar conductors to permit shifting of the ignited gas along the gas channels.

Both of the aforementioned patents require extremely careful dimensional tolerancing in laying out the conductors on a substrate, expecially to achieve line spacing down to 0.005 inches, which is thought to be necessary for good visual resolution. Since each of the conductor ends to be connected through a raised conductor post to a bus bar along an elevated plane must have an enlarged conductive pad for making this connection, the dimensional spacing of these conductors is even more critical. Conductor line widths are typically 0.001–0.002 inches (1–2 mils), and conductor edge-to-edge spacing is typically 0.003–0.005 inches (3–5 mils) which means that an enlarged conductor pad must be carefully placed so as to avoid electrical contact with an adjacent conductor, and the method chosen for developing the raised conductive posts must be precisely located so as to exactly position the conductive posts atop the enlarged conductive pads without contacting adjacent conductors. The manufacturing process for accomplishing this is very precisely controlled in order that a working AC plasma shift panel may be constructed within the dimensional tolerances required.

There is an alternative construction for panels of this type wherein raised conductive posts are not used to bridge selected conductors to an elevated planar level. The alternative construction utilizes dielectric or insulating deposits over the conductive lines which are to be bridged by a crossing conductor. Lines which are to be conductively coupled do not receive the dielectric or insulating spot deposit, but subsequently a conductive line is laid between these conductively coupled lines and over the dielectric or insulating spot deposits. This alternative also creates difficulties when used in conjunction with closely-spaced lines, for there is a danger that the dielectric or insulating spot deposits will cover the lines which are intended to be conductively coupled.

In addition to the foregoing problems, it has been noted in the prior art that a very critical relationship exists between the planar conductor-to-conductor spacing and the depth of the gas channel bridging these conductors. Until now this relationship has been unknown, but it has been observed that, for a given conductor-to-conductor spacing, if the gas channel depth is made large spurious ignition tends to occur between energized conductors and conductors at some distance away along the same gas channel, and if channel depth is made too small ignition does not always reliably occur even between adjacent planar conductor pairs.

This has been thought to be due to the electrical field pattern ganerated by the conductors, in combination with the mean free path of electrons in the gas, but the relationship has been generally undefined. In the foregoing two patents the preferred channel depth was selected through empirical procedures, without giving attention to planar conductor line spacing. It was known that performance of the panel could be influenced by proper choice of gas pressure and composition, and it was therefore believed that the relationship between planar conductor line spacing and channel depth was not critical.

SUMMARY OF THE INVENTION

The present invention provides a novel planar conductor line layout for maximizing spacing between adjacent conductors for providing external electrical connections to the conductor lines. The invention is also directed toward defining the critical relationship between gas channel depth and planar conductor line-to-line spacing for optimum operation of an AC plasma shift panel.

It is therefore a principal object of this invention to provide an AC plasma gas shift panel of simpler and more reliable construction than that known in the prior art.

It is another and more specific object of the present invention to provide improved planar conductor line spacing so as to permit easier interconnection to external electrodes.

It is yet another specific objective of the present invention to provide a definition of the critical nature of the relationship between the depth of the gas channel and the planar conductor line-to-line spacing in an AC plasma shift panel.

BRIEF DESCRIPTION OF THE DRAWINGS

The foregoing objects and advantages of the invention will become apparent from the following specification, and with reference to the appended drawings, in which.

DESCRIPTION OF THE PREFERRED EMBODIMENT

Figure 1:
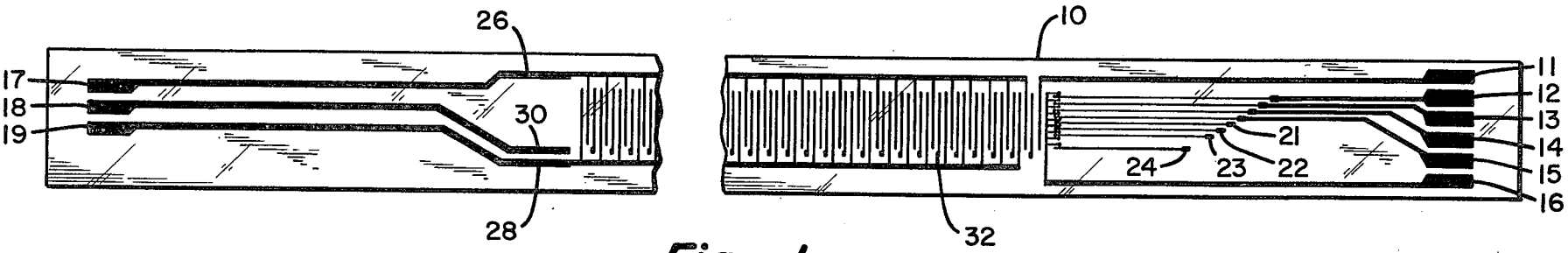
Fig. 1 PRIOR ART
FIG. 1 illustrates an AC plasma shift panel of the type known in the art.

Referring first to FIG. 1, there is shown a top view of an AC plasma shift panel of the type known in the prior art, portions of which have been deleted for clarity of understanding the drawing. A base plate 10, preferably made from glass, has embedded therein a plurality of conductor elements arranged in a predetermined pattern as shown on the figure. Each of the conductors is electrically connected to a conductive edge tab, shown as tabs 11—19, near an edge of base plate 10 for electrical connection external the AC plasma shift panel. Conductor tabs 12–15 are connected to external electrical circuitry for providing input data into the panel and for initiating the ignition of gas cells in the panel in channels aligned with the input data conductors. As illustrated in FIG. 1, the plasma panel is capable of accepting seven discreet input lines of information. Three of these input information paths are coupled to tabs 12, 13, 14, 15, and the remaining three information paths are coupled to similar tabs (not shown) which are electrically connected to conductive posts 21–23, which are raised to a different planar level to permit conductive lines to be coupled to them and to extend to the panel edge at a raised planar level for external connection. This technique of electrical connection to posts 21–23 is necessary because of space constraints along the edge of the panel where tabs 11–16 are located, requiring a second level of similar tabs for the remaining connections. Each of the conductive lines attached to tabs 12, 13, 14, and 15, as well as to conductive posts 21–23, are generally aligned with a gas channel which runs horizontally across the plasma panel above and in dielectric separation from the orthogonal conductors shown on the figure.

A plurality of conductive lines are arranged orthogonally relative to the gas channels, and these lines are connected in groups of three to respective different bus connectors which themselves are electrically attached to conductive tabs 17, 18 and 19. For example, every third conductor is electrically connected to an electrical bus 26 which in turn is connected to conductive tab 17. For convenience herein all such orthogonal lines connected to bus 26 shall be referred to as "A" lines. Adjacent to each A line is a similar orthogonal conductor connected to an electrical bus 28, which in turn is connected to conductive tab 19. For convenience herein all such lines shall be referred to herein as "B" lines. Similarly, adjacent to each B line is an orthogonal conductor which shall be for convenience referred to herein as an "S" line, all of such S lines being connected to electrical bus 30 which in turn is connected to conductive tab 18. The connection of the S lines to bus 30 is made via conductive posts which are connected to end tabs, for example end tab 32, on each S line. The conductive posts are elevated to a second planar level in the panel and are connected to a common line 36 (see FIG. 2) which is electrically connected to bus 30.

Figure 2:
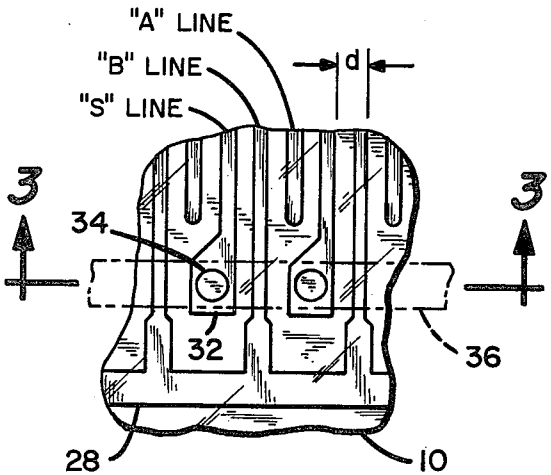
Fig. 2 PRIOR ART
FIG. 2 is an exploded view of a portion of the panel of FIG. 1.

FIG. 2 shows an exploded top view of a portion of the panel of FIG. 1, more clearly illustrating the S line connections. The end of each S line is expanded to form an enlarged pad 32, and a raised conductive post 34 is attached atop pad 32, Post 34 is attached to a conductor line 36, shown in dotted outline in FIG. 2, whch is at an elevated planar level, and line 36 is conductively attached to bus 30 as hereinbefore described.

The S, A, B lines are uniformly spaced along the plasma panel at a spacing "d" as shown in FIG. 2. Spacing "d" is preferably chosen to be about 0.005 inch (5 mils) in order to provide good visual resolution of the gas ignition which occurs in the region between adjacent lines. The width of a typical S, A, or B line is 1–3 mils, leaving an inter-line spacing of 2–4 mils, which creates fairly severe constructional tolerance constraints. These constraints are particularly severe in the construction and connection between pad 32 and post 34, for these elements are interconnected during different operational steps of the construction process. Pad 32 must be constructed of an enlarged surface area to allow for alignment errors during the later connection of post 34 to pad 32. However, the relatively close line-to-line spacing leaves only a limited area between lines in which to construct pad 32. It is for this reason that the ends of the S lines are extended beyond the ends of adjacent A lines, permitting pad 32 to be placed in the inter-line spacing between adjacent B lines, which nominally provides for approximately 10 mils of inter-line distance within which to construct pad 32.

Figure 3C:
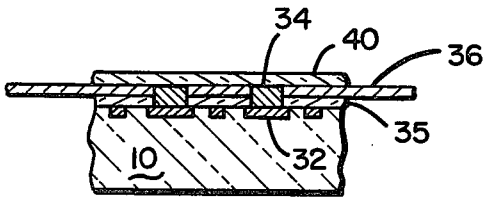
Fig. 3C PRIOR ART
FIGS. 3A–3C are views taken along the line 3—3 of FIG. 2 at three different steps of construction.
Figure 3A:
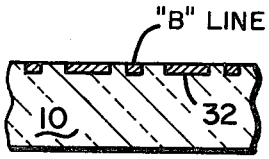
Fig. 3A PRIOR ART
Figure 3B:
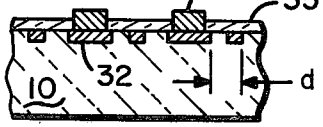
Fig. 3B PRIOR ART

FIGS. 3A-3C are views taken along the line 3—3 of FIG. 2 at three different steps of construction, to illustrate the relative alignment difficulties. FIG. 3A shows base plate 10 having conductive pad 32 deposited between a B line and an A line. FIG. 3B illustrates a post 34 attached to pad 32 by means of a deposition or plating process, and a glass insulating layer 35 applied over the conductor lines to a depth below the top surface of post 34. FIG. 3C shows a line 36 at an elevated planar level attached to post 34 and other similar posts, and a further glass layer 40 applied over this elevated planar level. A number of constructional steps are represented in FIGS. 3A-3C, each of which requires precise alignment of the panel elements in order to achieve proper constructional connections. Very small alignment errors will result in post 34 coming into electrical contact with either an A line or a B line, thus destroying the operating effectiveness of the panel.

Figure 4:
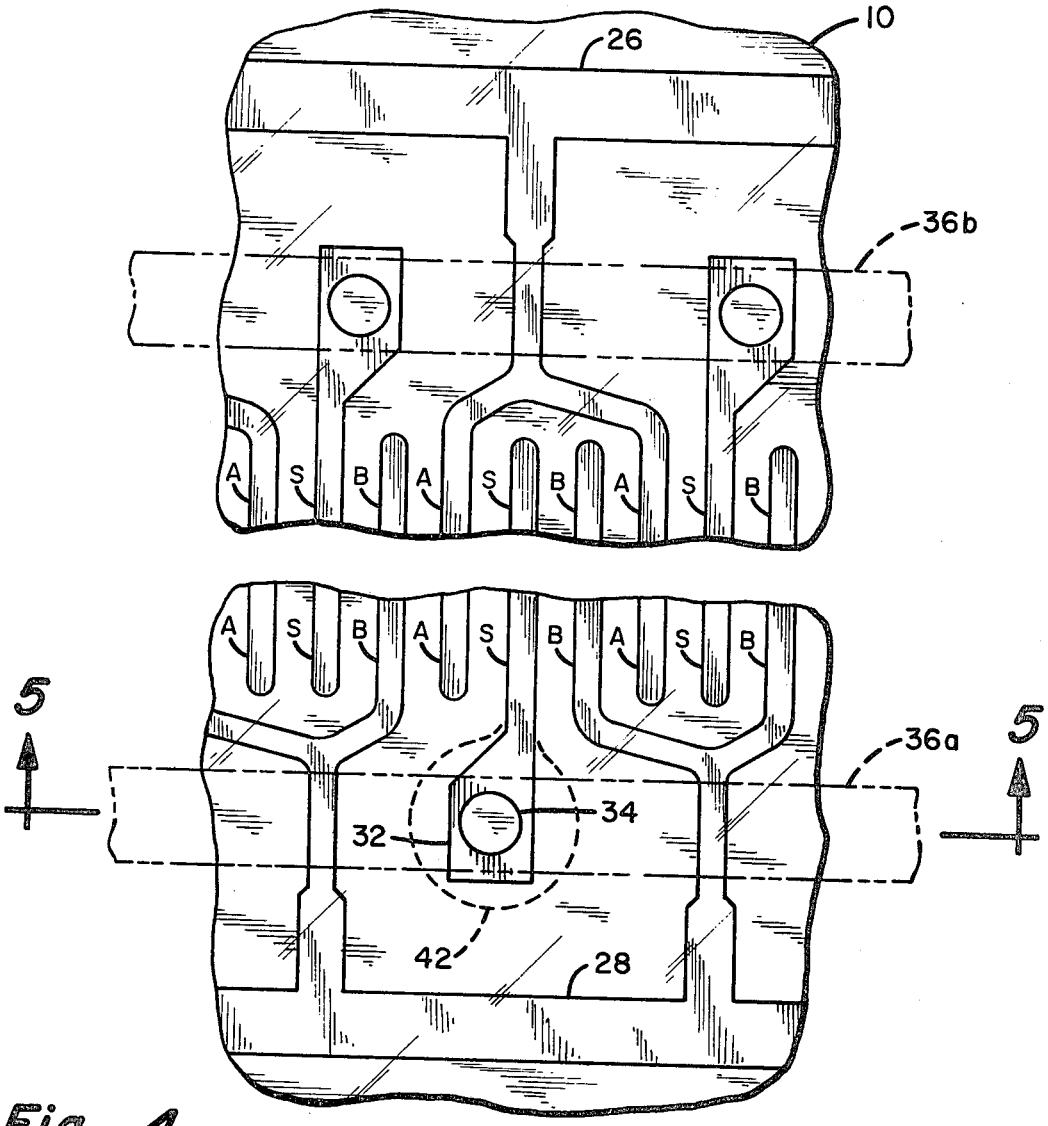
FIG. 4 illustrates an alternate construction which accomplishes the advantages of the invention.

FIG. 4 shows an improved construction wherein electrical panel connections may be made free from the disadvantages of close dimensional tolerancing, while retaining the advantages of close inter-line spacing for good visual resolution. The improvement is accomplished by interconnecting pairs of "B" lines along one side of the panel and extending the interconnecting conductor to bus 28, and by interconnecting pairs of "A" lines along the other side of the panel and similarly extending the conductor interconnection to bus 26. This effectively triples the spacing between pad 32 and any adjacent conductor, and provides for the possibility of expanding the area of pad 32, as for example shown by dotted outline 42 in FIG. 4.

Figure 5:
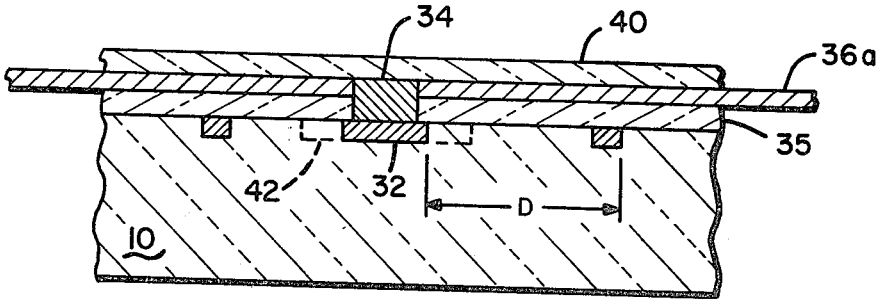
FIG. 5 is a view taken along the line 5—5 of FIG. 4.

FIG. 5 illustrates a view taken along the lines 5—5 of FIG. 4, wherein the inter-conductor spacing D is greatly increased from that shown in FIG. 2. An expanded pad 42 is shown in dotted outline to illustrate the greatly relaxed dimensional tolerancing provided by the construction of FIG. 4, for it is apparent that post 34 may be misaligned by a considerable amount over pad 42 and still provide adequate electrical connection and freedom from the possibility of bridging to adjacent conductors.

Figure 6:
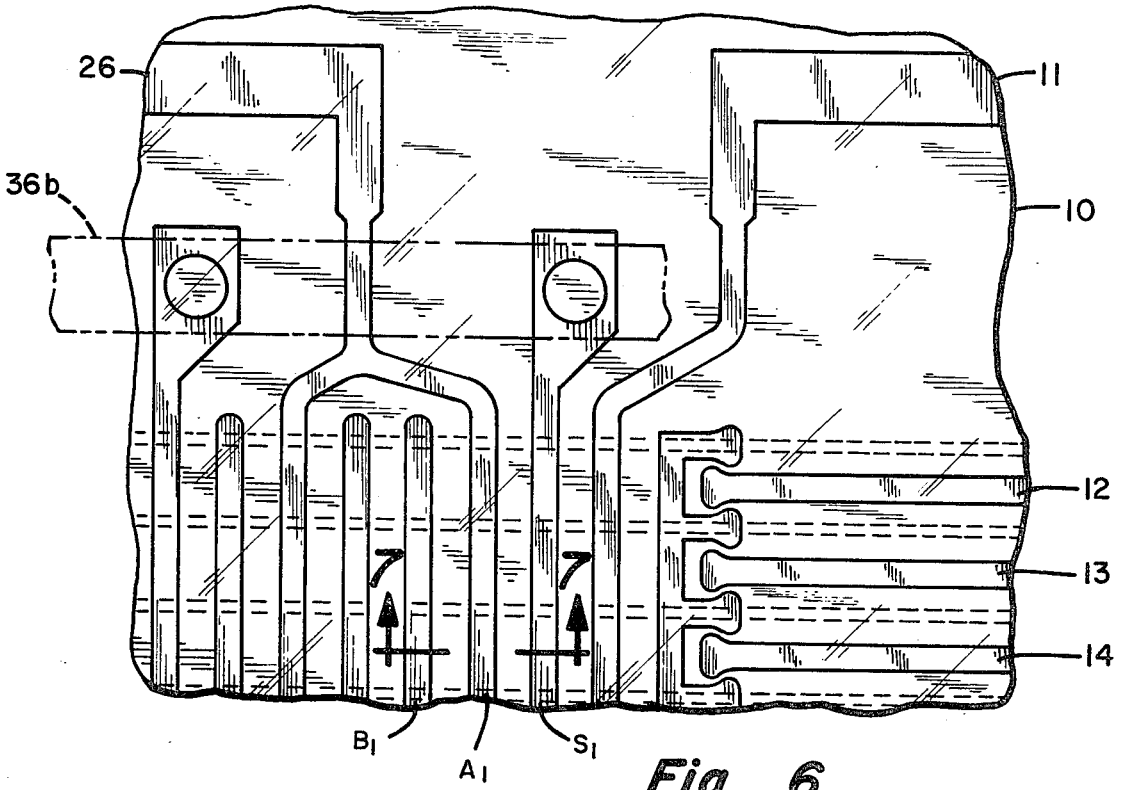
FIG. 6 shows the relationship between gas channel depth and conductor line-to-line spacing according to the teachings of the invention.

FIG. 6 shows an exploded top view of a portion of the plasma panel of FIG. 4 including the input conductors connected to conductive tabs 12, 13 and 14. A number of orthogonal conductor lines are shown, including lines $B_1$, $A_1$, and $S_1$. Line $S_1$ is connnected to a bus conductor 36*b* according to the techniques previously described, bus conductor 36*b* being at an elevated planar level relative to the conductor connections to the B and A lines.

Figure 7:
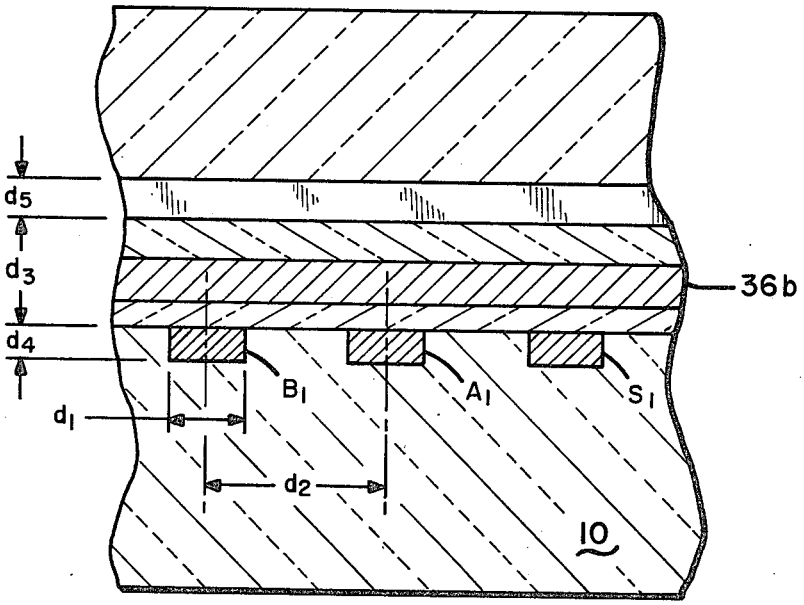
FIG. 7 is a view taken along the line 7—7 of FIG. 6.

FIG. 7 shows a cross-sectional view taken along the lines 7—7 of FIG. 6, wherein the relative dimensions of critical components are shown. The width $d_1$ of the lines is preferably 1-3 mils and the thickness $d_4$ of the lines is preferably about 0.5 mils. The thickness $d_3$ of the glass dielectric layer overlaying the lines and separating them from the gas channel is preferably 1-1.5 mils. The line-to-line spacing is preferably about 5 mils for a good resolution of the panel. In operation, the visible gas ignition which occurs within the panel occurs in the gas channel across the region bridging adjacent orthogonal lines, or effectively across the distance $d_2$. It has been found that a critical relationship exists between the depth $d_5$ of the gas channels and the inter-line spacing $d_2$ of the orthogonal conductors. This relationship must be such that the electric field developed from adjacent orthogonal conductors is sufficiently confined within the gas channel depth so as to prevent field spreading effects which influence conductors positioned farther along the gas channel. On the other hand, if the gas channel is made too shallow the electric field effects developed between adjacent conductors is insufficient to influence gaseous ignition even in the region between the conductors. It has been determined that a gas channel depth of between 0.2 and 0.4 times the inter-line spacing produces optimum ignition characteristics between adjacent orthogonal lines, without causing erratic ignition characteristics at other points along the gas channel. Therefore, in the preferred embodiment, wherein the inter-line spacing is nominally 5 mils, the gas channel depth $D_5$ is 1-2 mils for optimum operation.

The present invention may be embodied in other specific forms without departing from the spirit or essential attributes thereof, and it is therefore desired that the present embodiment be considered in all respects as illlustrative and not restrictive, reference being made to the appended claims rather than to the foregoing description to indicate the scope of the invention.

I claim:

1. In an AC plasma shift display panel of the type having parallel planar conductor segments transversely oriented to a plurality of gas channels wherein dielectric separation exists between the planar conductor segments and gas channels, and wherein every third planar conductor segment is electrically driven by a common voltage excitation source A, B or S, the improvement in connecting said planar conductor segments to said voltage sources comprising:

(a) a plurality of parallel and spaced bus connectors extending orthogonal to said planar conductor segments, one bus connector at the same planar level and one bus connector at a different planar level than said planar conductor segments at spaced intervals adjacent respective first and second ends of said planar conductor segments;

(b) means for connecting said planar conductor segments to said bus connectors in repeatable patterns of six, comprising (i) means for interconnecting the ends of the first and fourth planar conductor segments and means for connecting the interconnected ends to a first bus connector adjacent the first planar conductor segment ends;

(ii) means for interconnecting the ends of the third and sixth planar conductor segments and means for connecting the interconnected ends to a second bus connector adjacent the second planar conductor segment ends;

(iii) means for connecting the second planar conductor segment to a third bus connector adjacent the first planar conductor segment ends; and (iv) means for connecting the fifth planar conductor segment to a fourth bus connector adjacent the first planar conductor segment ends;

(c) means for interconnecting the third and fourth bus connectors and for connecting same to a voltage excitation source S; and (d) means for connecting the first bus connector to a voltage excitation source A and for connecting the second bus connector to a voltage excitation source B.

2. The apparatus of claim 1, wherein said third and fourth bus connectors are at a different planar level than said planar segments.

3. The apparatus of claim 1, wherein said first and second bus connectors are at a different planar level than said planar conductor segments.

4. The apparatus of claim 2, further comprising a conductive pad on the respective ends of the second and fifth planar conductor segments, and a raised conductive post bridging between said pad and said bus connector.

5. The apparatus of claim 4 wherein said conductive pads are respectively located between said means for interconnecting and said first or second bus connector.

6. The apparatus of claim 1 further comprising a glass baseplate for supporting all of said planar conductor segments and said bus connectors.

7. The apparatus of claim 6 further comprising a first glass layer overlaying said planar conductor segments and two of said bus connectors.

8. The apparatus of claim 7 further comprising two of said bus connectors overlaying said first glass layer.

9. The apparatus of claim 8, further comprising a second glass layer overlaying said first glass layer and said bus connectors.

10. The apparatus of claim 9, further comprising a glass sheet having channels therein overlaying said second glass layer, said channels being orthogonally positioned relative to said planar conductor segments.

11. The apparatus of claim 10 wherein said channels have a depth D which is greater than 0.2 of the planar conductor segment spacing.

12. The apparatus of claim 11, wherein said channels have a depth D which is less than 0.4 of the planar conductor segment spacing.

* * * * *